US008790092B2

(12) United States Patent
Mueller et al.

(10) Patent No.: US 8,790,092 B2
(45) Date of Patent: Jul. 29, 2014

(54) HIGH-PRESSURE CLEANING APPLIANCE

(75) Inventors: Wolfgang Mueller, Geradstetten (DE); Sven Dirnberger, Steinheim (DE); Bernd Koerner, Berglen-Spechtshof (DE)

(73) Assignee: Alfred Kaercher GmbH & Co. KG, Winnenden (DE)

( * ) Notice: Subject to any disclaimer, the term of this patent is extended or adjusted under 35 U.S.C. 154(b) by 90 days.

(21) Appl. No.: 12/586,068

(22) Filed: Sep. 15, 2009

(65) Prior Publication Data

US 2010/0059603 A1 Mar. 11, 2010

Related U.S. Application Data

(63) Continuation of application No. PCT/EP2008/002818, filed on Apr. 10, 2008.

(30) Foreign Application Priority Data

Apr. 11, 2007 (DE) ..... 10 2007 017 970

(51) Int. Cl.
*F04B 49/03* (2006.01)

(52) U.S. Cl.
USPC ..... 417/309

(58) Field of Classification Search
USPC ..... 417/307, 308, 309, 311; 239/124
See application file for complete search history.

(56) References Cited

U.S. PATENT DOCUMENTS

| | | | | |
|---|---|---|---|---|
| 2,018,119 | A | 10/1935 | Brouse | |
| 2,562,615 | A | 7/1951 | Huber | |
| 2,806,430 | A | 9/1957 | Osborne | |
| 3,018,737 | A | 1/1962 | Cook et al. | |
| 3,362,335 | A * | 1/1968 | Stephens et al. | 417/304 |
| 3,754,842 | A | 8/1973 | Schlanzky | |
| 4,692,102 | A * | 9/1987 | Hafele et al. | 417/296 |
| 4,784,368 | A | 11/1988 | Koch et al. | |
| 5,013,219 | A | 5/1991 | Hicks et al. | |
| 5,259,556 | A | 11/1993 | Paige et al. | |
| 5,397,054 | A | 3/1995 | Ziegs | |
| 5,409,032 | A | 4/1995 | Berfield | |
| 5,735,461 | A * | 4/1998 | Winther | 239/124 |
| 5,950,669 | A * | 9/1999 | Fehlmann et al. | 137/493.3 |
| 6,497,247 | B1 * | 12/2002 | Kinoshita et al. | 137/493.9 |
| 2007/0267063 | A1 * | 11/2007 | Davis | 137/115.11 |

FOREIGN PATENT DOCUMENTS

| | | | |
|---|---|---|---|
| CN | 2694014 | 4/2005 | |
| DE | 2705585 | * 11/1977 | F16K 17/04 |
| DE | 32 48 622 | 7/1984 | |

(Continued)

*Primary Examiner* — Bryan Lettman

(74) *Attorney, Agent, or Firm* — Lipsitz & McAllister, LLC

(57) ABSTRACT

A high-pressure cleaning appliance with a high-pressure pump is provided. The pump has at least one pump chamber connected to a suction line and a pressure line. The pressure line is in flow connection with the suction line via a return flow line. A relief valve with a through-channel extending from a valve inlet to a first valve outlet is arranged in the return flow line. A valve element which in a closed position bears against a valve seat is held for movement in the through-channel. At least one outlet channel, which opens into a second valve outlet, branches off from the through-channel. The valve element is surrounded by a sealing ring which seals off an inlet area of the through-channel adjacent to the valve inlet from an outlet area of the through-channel adjacent to the first valve outlet.

7 Claims, 5 Drawing Sheets

(56) References Cited

FOREIGN PATENT DOCUMENTS

| | | | | |
|---|---|---|---|---|
| DE | 85 14 497 | 8/1985 | | |
| DE | 36 34 827 | 4/1988 | | |
| DE | 39 36 155 | 5/1991 | | |
| DE | 42 21 286 | 1/1993 | | |
| DE | 93 01 796 | 5/1993 | | |
| DE | 43 28 382 | 3/1994 | | |
| DE | 44 04 925 | 8/1995 | | |
| DE | 44 45 519 | 6/1996 | | |
| DE | 296 11 935 | 10/1996 | | |
| DE | 297 03 009 | 6/1997 | | |
| DE | 196 07 881 | 9/1997 | | |
| DE | 196 17 778 | 10/1997 | | |
| DE | 297 12 659 | 10/1997 | | |
| DE | 197 28 225 | 1/1999 | | |
| DE | 696 02 551 | 9/1999 | | |
| DE | 10 2008 059 782 | 6/2009 | | |
| EP | 0 608 796 | 8/1994 | | |
| EP | 0 631 054 | 12/1994 | | |
| EP | 0 668 113 | 8/1995 | | |
| EP | 0 793 017 | 9/1997 | | |
| EP | 1 234 980 | 8/2002 | | |
| EP | 1 496 252 | 1/2005 | | |
| FR | 2341087 | * 9/1977 | ..... | F16K 17/04 |
| FR | 2341087 | * 10/1997 | ..... | B62D 5/06 |
| JP | 2006-207833 | 8/2006 | | |

* cited by examiner

HIGH-PRESSURE CLEANING APPLIANCE

This application is a continuation of international application number PCT/EP2008/002818 filed on Apr. 10, 2008.

The present disclosure relates to the subject matter disclosed in international application number PCT/EP2008/002818 of Apr. 10, 2008 and German application number 10 2007 017 970.9 of Apr. 11, 2007, which are incorporated herein by reference in their entirety and for all purposes.

BACKGROUND OF THE INVENTION

The invention relates to a high-pressure cleaning appliance with a high-pressure pump, comprising at least one pump chamber which is connected to a suction line and a pressure line, the pressure line being in flow connection with the suction line via a return flow line, and a relief valve being arranged in the return flow line, the relief valve having a through-channel, which extends from a valve inlet to a first valve outlet, and which forms a valve seat, at least one outlet channel, which opens into a second valve outlet, branching off from the through-channel downstream of the valve seat, and a valve element adapted to be positioned by a return spring in a sealing manner against the valve seat being held for movement in the through-channel.

Such high-pressure cleaning appliances are known from DE 297 12 659 U1. A surface to be cleaned can be acted upon with a pressurized cleaning liquid, for example, with water, by means of these. For this purpose, a high-pressure hose carrying at its free end, for example, a spray lance for spraying the surface to be cleaned can be connected to the pressure line.

During normal operation, cleaning liquid can be supplied to the pump chamber via the suction line. The cleaning liquid is pressurized inside the pump chamber, for example, by means of a piston which is reciprocatingly displaceable and enters the pump chamber. The pressurized cleaning liquid can then be fed to a consumer via the pressure line. In this operating state, the relief valve is in its closed position, so that the direct connection between the pressure line and the suction line via the return flow line is interrupted. When a certain pressure value inside the pressure line is exceeded, as occurs, for example, upon closing a spray lance connected to the free end of the high-pressure hose, the relief valve transfers to its open position by the valve element, in opposition to the returning force exerted by the return spring, lifting off of the valve seat, so that cleaning liquid can flow back directly from the pressure line via the return flow line through the relief valve to the suction line and the pressure in the pressure line thereby dropping. The pressure drop may have the consequence that shortly after lifting off of the valve seat, the valve element is pressed back onto the valve seat again by the return spring, to then lift off of the valve seat again. The transition of the relief valve from the closed position to the open position of the relief valve may therefore be accompanied by an oscillating movement of the valve element and the return spring. This oscillating movement constitutes a considerable mechanical load. This may lead to failure of the high-pressure cleaning appliance.

SUMMARY OF THE INVENTION

The object of the present invention is to so develop a high-pressure cleaning appliance of the kind mentioned at the outset that it is less susceptible to failure.

This object is accomplished, in accordance with the invention, in a high-pressure cleaning appliance of the generic kind in that in the direction away from the valve seat, at a spacing from the at least one outlet channel, the valve element is surrounded by a sealing ring which seals off an inlet area of the through-channel adjacent to the valve inlet from an outlet area of the through-channel adjacent to the first valve outlet.

As mentioned above, when a pressure peak occurs in the pressure line, the relief valve transfers to its open position in which the valve element lifts off of the valve seat. The flow connection between the valve inlet and the second valve outlet is thereby opened, so that cleaning liquid can flow through the inlet area of the through-channel via the at least one outlet channel to the second valve outlet. In the inlet area of the through-channel, i.e., in the area of the through-channel between the valve inlet and the sealing ring, the valve element is, therefore, under a considerable pressure load. On the side of the sealing ring facing away from this area, namely within the outlet area of the through-channel, the valve element is, in contrast, subjected to a considerably lower pressure load. The pressure difference acting as a result on the valve element has the consequence that the tendency of the valve element to oscillate is strongly reduced. Use of the sealing ring, which seals off the inlet area of the through-channel from its outlet area, therefore, has the consequence that the mechanical load on the valve element and the return spring can be reduced. The risk of spring breakage, caused by unintentional oscillatory movement of the valve element, can thereby be significantly reduced. The high-pressure cleaning appliance according to the invention, is therefore, characterized by a low susceptibility to failure.

The opening force acting on the valve element in the open position of the relief valve, which results from the above-explained pressure difference, is dependent upon the size of the sealed-off surface defined by the sealing ring. Therefore, the opening force can be influenced by the choice of the size of the surface.

Upon occurrence of a pressure peak, the liquid flowing into the relief valve can flow back from the pressure line of the high-pressure cleaning appliance into the suction line via the at least one outlet channel and the second valve outlet. Cleaning liquid, which in the case of leakage, can flow past the sealing ring surrounding the valve element, can flow out of the relief valve via the first valve outlet. The first valve outlet therefore forms a leakage opening. It also enables pressure compensation between the pressure prevailing in the suction line and the pressure in the outlet area of the through-channel. After reduction of the pressure peak in the pressure line, the relief valve automatically returns to its closed position again on account of the returning force of the return spring acting on the valve element.

The sealing ring may, for example, be arranged in a groove machined in the wall of the through-channel, and the valve element may be movable back and forth relative to the sealing ring, with the sealing ring bearing in a sealing manner on the circumference of the valve element.

Alternatively, it may be provided that the sealing ring is arranged in a circumferential groove of the valve element. In such a configuration, it is of advantage for the inner diameter of the sealing ring to be greater than the diameter of the bottom of the circumferential groove of the valve element. For, this has the consequence that the sealing ring is accommodated by the circumferential groove, but does not bear with its inner rim on the bottom of the circumferential groove. There is, however, a sealing contact between the outer rim of the sealing ring and the wall of the through-channel. It has been found that the valve element can thereby be held with greater ease of movement in the through-channel.

It is of advantage for the valve element to comprise a closure member which is adapted to be positioned in a sealing manner against the valve seat, and a pressure member which is surrounded by the sealing ring at a spacing from the closure member. The closure member may, for example, be of spherical or conical configuration. Closure member and pressure member may be connected to each other with a substance-to-substance bond, more particularly, it may be provided that closure member and pressure member form a valve element of integral configuration.

In a preferred embodiment of the invention, the through-channel comprises a guide section, on the inner wall of which the pressure member is mounted for displacement, with the sealing ring disposed between these. The guide section forms a sliding guide for the valve element and provides on its inner wall the sealing surface associated with the sealing ring.

To ensure that upon occurrence of a pressure peak in the pressure line, the desired pressure drop will require a certain time, i.e., the relief valve, starting from its open position, will only gradually adopt its closed position in which the valve element again bears in a sealing manner on the valve seat, it is of advantage for the flow cross section of the through-channel in the area upstream of the at least one outlet channel to be greater than the flow cross section of the outlet channel. The outlet channel therefore forms a throttle element, so that a considerable pressure arises upstream of the outlet channel when the relief valve adopts its open position. The flow of cleaning liquid entering the relief valve encounters a resistance in the area of the decreasing flow cross section, so that the pressure prevailing in the inlet area of the through-channel is gradually reduced.

It is particularly advantageous for the relief valve to comprise a single outlet channel, as the costs for manufacturing the relief valve can thereby be kept low, and a considerable throttle effect can be produced by the single outlet channel.

It is expedient for the valve element to at least partially open the at least one outlet channel in both the open position and the closed position of the relief valve. Such a configuration has the effect that once the valve element lifts off of the valve seat, a continuous flow connection from the valve inlet via the inlet area of the through-channel and the outlet channel to the second valve outlet is immediately ensured, i.e., incoming liquid can already flow through the relief valve upon a slight lifting movement of the valve element off of the valve seat, it not being necessary for the valve element to adopt a minimum spacing from the valve seat in order to open the flow connection between valve inlet and second valve outlet.

In a preferred embodiment, there is associated with the valve element a stop on which the valve element bears when the relief valve is in the open position. The stop forms a defined delimitation for the stroke of the valve element, so that the desired stroke of the valve element may be structurally predefined by the position of the stop.

It may be provided that the stop is formed by a narrowing of the through-channel. For example, the through-channel may form a step on which the valve element can bear when the relief valve is in the open position.

Alternatively, it may be provided that the stop is formed by a supporting element arranged in the through-channel. Such a configuration has the advantage that the position of the stop delimiting the stroke of the valve element can be predefined by choice of the supporting element. In a preferred configuration, the supporting element projects radially inwardly from an inner wall of the through-channel.

In a preferred configuration, the relief valve comprises a first housing part and a second housing part, which are connectable to each other with a sealing ring disposed between these. A releasable or also an unreleasable connection, for example, a locking or screw connection, may be used to connect the two housing parts.

The first housing part preferably comprises the valve inlet, the valve seat and the at least one outlet channel and the second valve outlet, and the second housing part preferably comprises the first valve outlet.

It is expedient for the second housing part to comprise an insert which is insertable into the first housing part with a sealing ring disposed between these. It is of advantage for the insert to carry on the outside an annular groove in which the sealing ring is arranged. The insert may be of, for example, cup-shaped configuration and accommodate the end area of the valve element that faces away from the valve seat. In this end area, the valve element may comprise an annular groove in which there is arranged the sealing ring surrounding the valve element.

The return spring is preferably clamped between a collar of the valve element and an end face of the second housing part.

The following description of two preferred embodiments of the invention serves for a more detailed explanation in conjunction with the drawings.

DETAILED DESCRIPTION OF THE INVENTION

Figure 1:
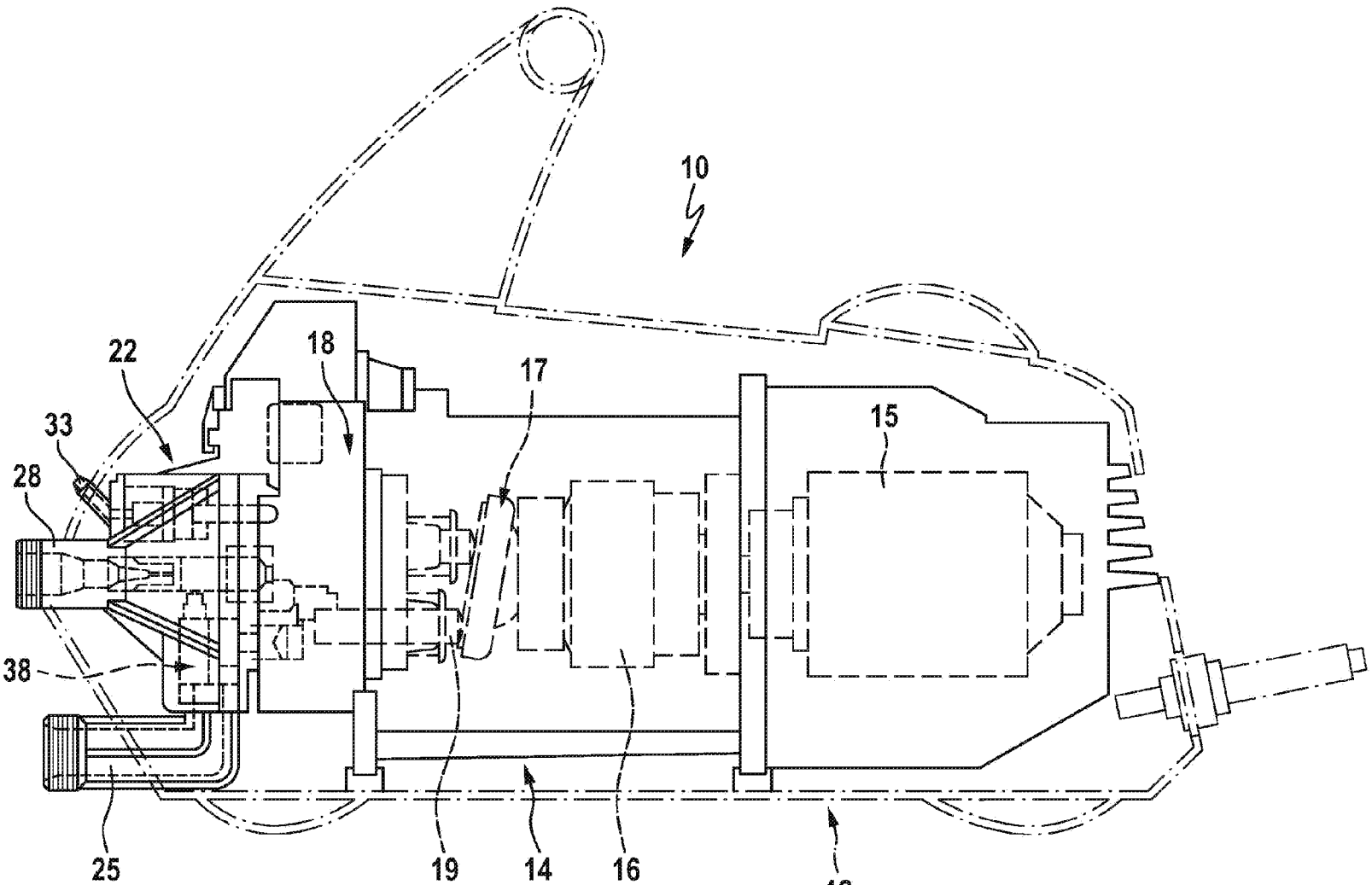
FIG. 1 shows a schematic side view of a high-pressure cleaning appliance according to the invention.
Figure 2:
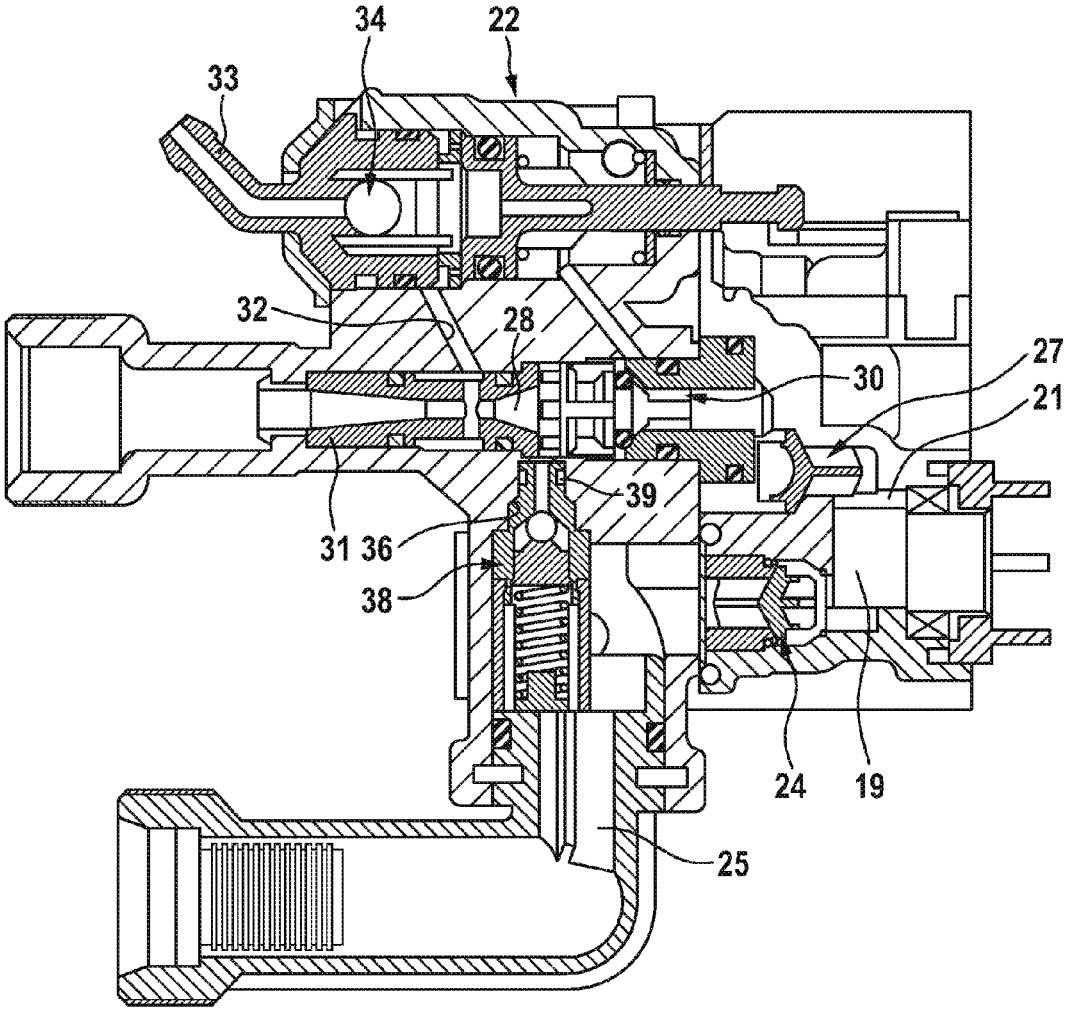
FIG. 2 shows an enlarged longitudinal sectional view of the pump head of the high-pressure cleaning appliance from FIG. 1.

A high-pressure cleaning appliance 10 having an appliance housing 12 which accommodates a motor pump unit 14 is shown diagrammatically in FIGS. 1 and 2. The motor pump unit 14 comprises an electric motor 15 followed by a gearing 16 and a piston pump 18 driven via a swash plate 17 and having a number of pistons 19 reciprocatingly displaceable in the axial direction of the high-pressure cleaning appliance 10. These respectively enter a pump chamber 21 of a pump head 22 of the high-pressure cleaning appliance 10. The pump chambers 21 are respectively connected via a suction valve 24 to a suction line 25 and via a pressure valve 27 to a pressure line 28. Here the suction line 25 and the pressure line 28 are common to all pump chambers 21 of the pump head 22.

Inserted in the pressure line 28 is a spring-loaded non-return valve 30, which is followed in the direction of flow by an injector 31 which reduces the flow cross section of the pressure line 28. At its narrowest point, the injector 31 is connected via a suction channel 32 to a chemical intake line 33, which is closed by a non-return valve 34.

In the area between the non-return valve 30 arranged in the pressure line 28 and the injector 31, a return flow line 36, which widens in stepped configuration in the direction of flow, leads directly from the pressure line 28 to the suction line 25. Inserted in the return flow line 36 is a relief valve 38, which is configured as a cartridge that can be handled independently. The relief valve 38 is surrounded in the circumferential direction by a sealing ring 39 which bears in a sealing manner against the wall of the return flow line 36.

Figure 3:
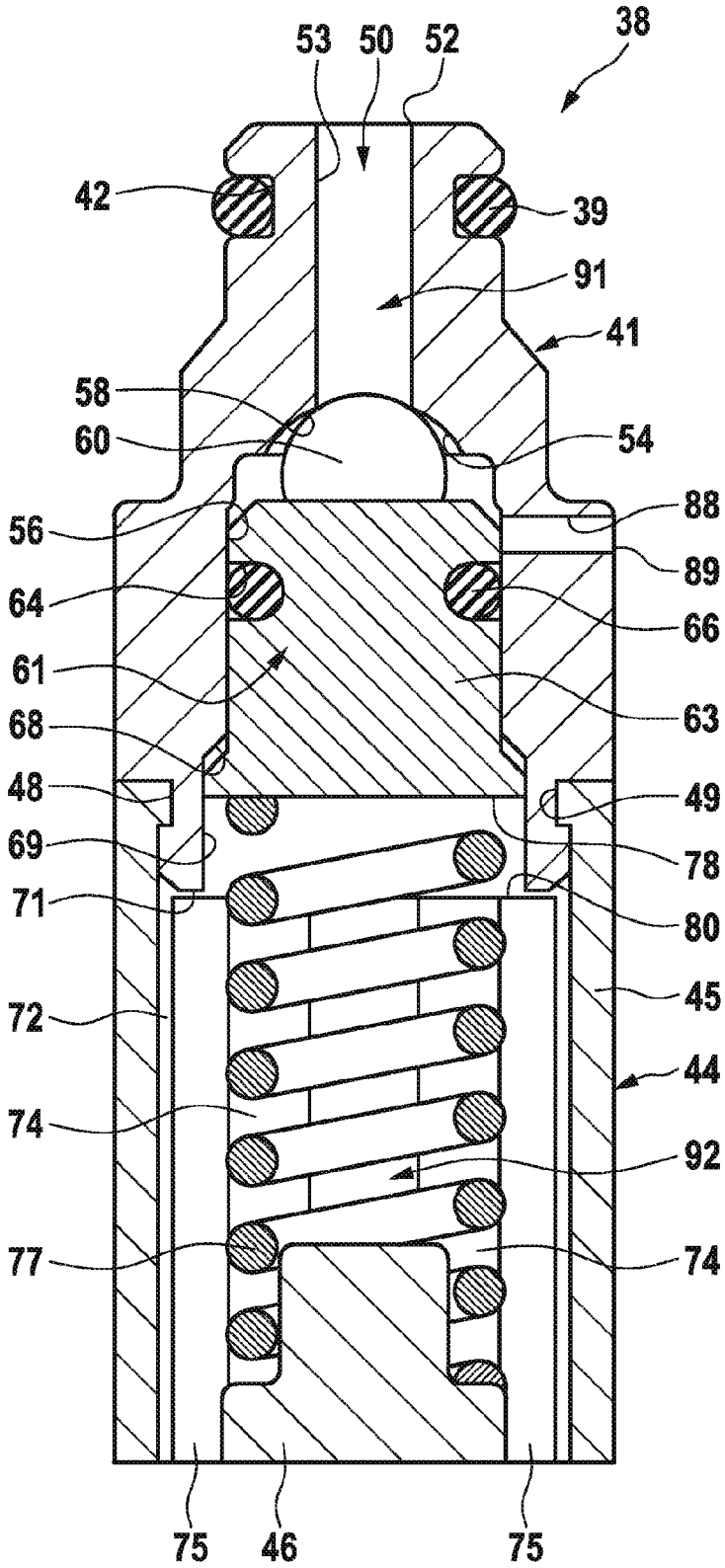
FIG. 3 shows a longitudinal sectional view of a first embodiment of a relief valve of the high-pressure cleaning appliance from FIG. 1.

The relief valve 38 is shown on an enlarged scale in FIG. 3. It comprises a two-part housing with a first housing part 41, which carries the sealing ring 39 in a circumferential groove 42 and is insertable in a sealed manner into the return flow line 36. The relief valve 38 also comprises a second, cup-shaped housing part 44 with a cylindrical casing 45 and a bottom wall 46. The second housing part 44 is locked to the first housing part 41. For this purpose, the first housing part 41 has at its end directed away from the circumferential groove 42 an annular groove 48 in which an inwardly projecting annular shoulder 49 of the second housing part 44 may engage elastically when the second housing part 44 is pushed in the axial direction onto the first housing part 41.

The two housing parts 41 and 44 define a through-channel 50 which, starting from a valve inlet 52 at an end face, forms a first channel section 53, which passes via a spherical widening 54 into a second channel section 56. The widening 54 forms a valve seat 58 for the closure member 60 of a valve element 61 held in the through-channel 50 for movement in the longitudinal direction of the through-channel 50. The closure member 60 is in the form of a spherical cap and bears in a sealing manner against the valve seat 58 in the closed position of the relief valve 38 shown in FIG. 3. The closure member 60 is followed in the axial direction by a pressure member 63 of the valve element 61. The pressure member 63 is in the form of a piston and carries on its outer side a circumferential groove 64 in which a sealing ring 66 surrounding the valve element 61 in the circumferential direction is arranged. The sealing ring 66 bears against the wall of the through-channel 50 in the area of its second channel section 56.

The second channel section 56 is followed in the axial direction via a conical widening 68 by a third channel section 69, which passes via a stepped widening 71 into a fourth channel section 72. The fourth channel section 72 is defined by the casing 45 of the second housing part 44. It comprises axially extending longitudinal ribs 74, which project radially inwardly from the casing 45 and extend as far as first valve outlets 75 which penetrate the bottom wall 46.

The fourth channel section 72 accommodates a return spring 77 configured as a helical spring, which is supported, on the one hand, on the bottom wall 46 of the second housing part 44 and, on the other hand, on the underside 78 of the pressure member 63, which faces the bottom wall 46. The pressure member 63 and the closure member 60 are acted upon by a spring force in the direction of the valve seat 58 by means of the return spring 77, so that in the closed position of the relief valve 38, the closure member 60 bears tight against the valve seat 58, as shown in FIG. 3.

The upper end face 80 of the longitudinal ribs 74, which faces the pressure member 63, forms a stop for the pressure member 63 of the valve element 61, when, in the open position of the relief valve 38, the pressure member 63 lifts off the valve seat 58. This will be explained in further detail hereinbelow.

The first housing part 41 has at a spacing from the valve seat 58 in the second channel section 56 of the through-channel 50 a radially extending outlet channel 88, whose radially outwardly lying end area forms a second valve outlet 89 of the relief valve 38.

The sealing ring 66 surrounding the valve element 61 in the circumferential direction divides the through-channel 50 into an inlet area 91 and an outlet area 92. The inlet area 91 is formed by the first channel section 53, the spherical widening 54 and the area of the second channel section 56 that surrounds the closure member 60. The outlet area 92 is formed by the area of the second channel section 56 that follows the closure member 60, by the conical widening 68, by the third channel section 69 and by the stepped widening 71 and the fourth channel section 72.

During normal operation of the high-pressure cleaning appliance 10, i.e., when pressurized cleaning liquid is issued through the pressure line 28 to a high-pressure hose (not shown in the drawings) connectable to the pressure line 28, the valve element 61 is pressed by the return spring 77 against the valve seat 58, so that the relief valve 38 adopts its closed position in which the flow connection from the valve inlet 52 via the inlet area 91 of the through-channel 50 and the outlet channel 88 to the second valve outlet 89 is interrupted.

When a certain pressure value of the cleaning liquid is exceeded, as may occur, for example, when switching off the high-pressure cleaning appliance 10, the valve element 61 is lifted off the valve seat 58 against the spring force of the return spring 77 and displaced downwards in the direction away from the valve seat 58 until the pressure member 63 bears with its underside 78 against the free end face 80 of the longitudinal ribs 74. The longitudinal ribs 74 therefore delimit the stroke of the valve element 61. The flow connection between the valve inlet 52 and the second valve outlet 89 is opened by the lifting of the valve element 61 off of the valve seat 58, and a considerable pressure arises within the inlet area 91 of the through-channel 50, whereas a considerably lower pressure, namely the pressure prevailing in the suction line 25, is present in the outlet area 92 of the through-channel 50, which is separated from the inlet area 91 by the sealing ring 66. Therefore, in the open position of the relief valve 38, a pressure difference acts on the valve element 61, as a result of which a force acting axially in opposition to the action of the return spring 77 is applied to the valve element 61, which reliably holds the valve element 61 at a spacing from the valve seat 58 until the pressure of the cleaning liquid in the inlet area 91 has dropped so far that the force of the return spring 77 is adequate to return the valve element to the valve seat 58. The pressure difference acting on the valve element 61 when the relief valve 38 is in the open position reduces the occurrence of oscillatory movements of the valve element 61.

Figure 4:
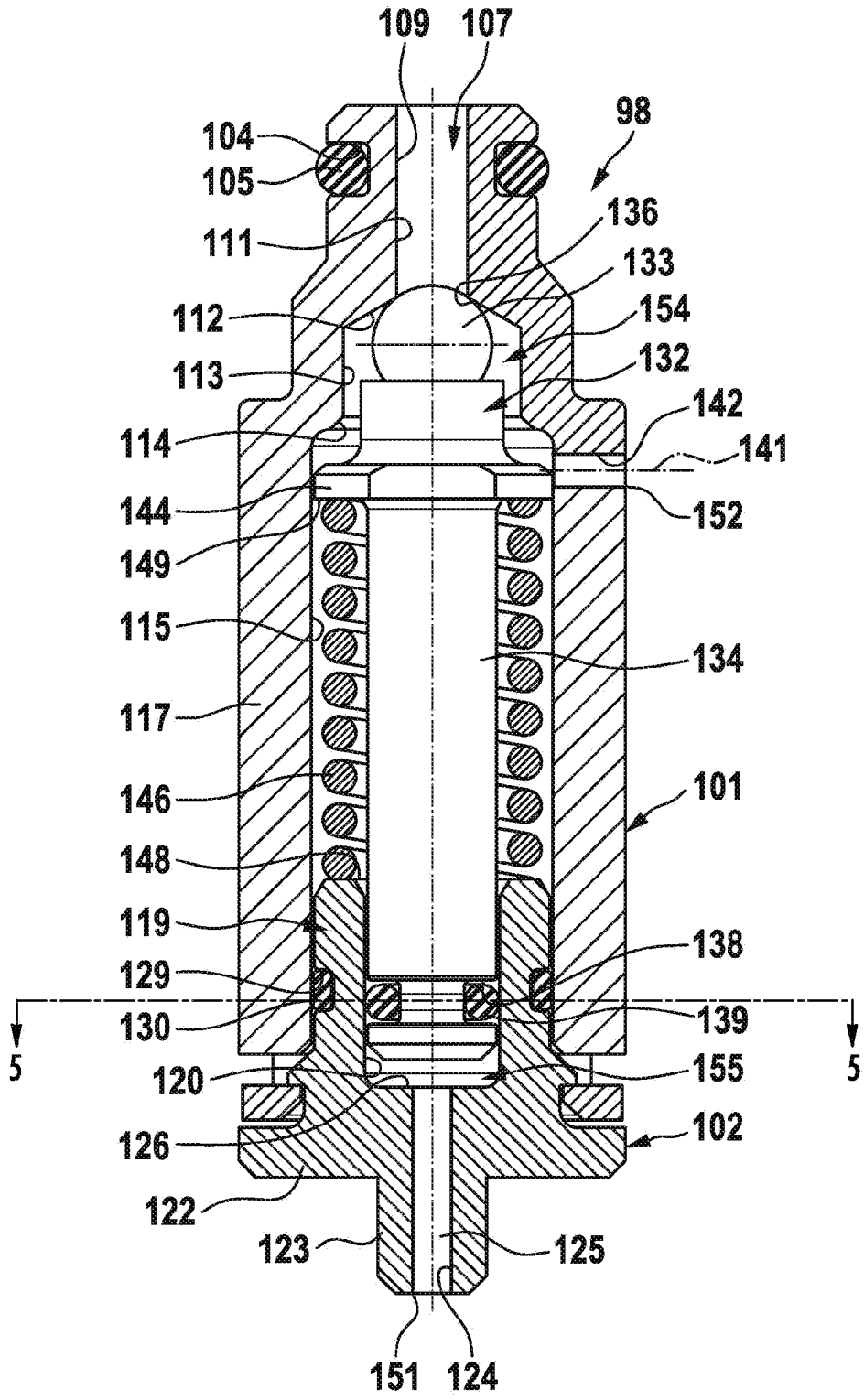
FIG. 4 shows a longitudinal sectional view of a second embodiment of a relief valve of the high-pressure cleaning appliance from FIG. 1.
Figure 5:
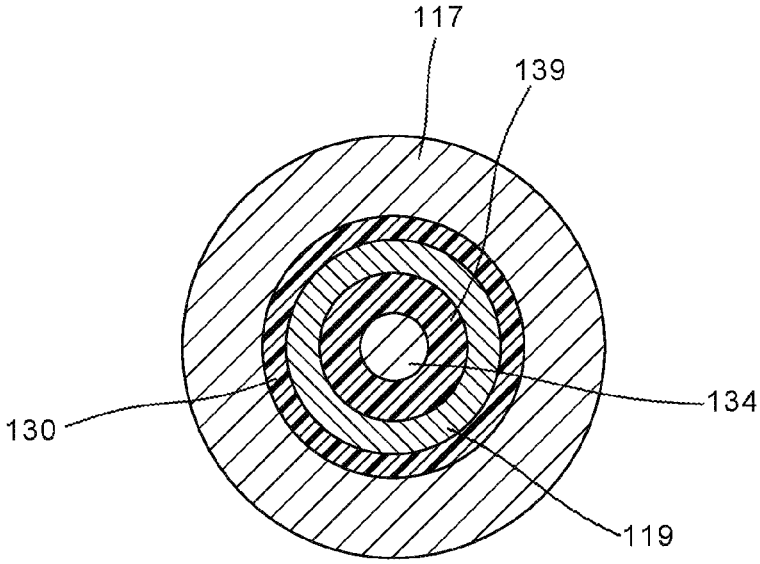

A second embodiment of a relief valve, which may be used alternatively to the relief valve 38 in the high-pressure cleaning appliance 10, is shown in FIG. 4. It is generally denoted by reference numeral 98. The relief valve 98 has a first housing part 101 and a second housing part 102. On the outside, the first housing part 101 carries a circumferential groove 104, which accommodates a sealing ring 105, which bears in a sealing manner against the wall of the return flow line 36 upon insertion of the relief valve 98, configured as a cartridge that can be handled independently, into the return flow line 36.

The housing parts 101 and 102 are locked to each other. Alternatively, a screw connection could, for example, also be used to releasably connect the two housing parts 101, 102.

The two housing parts 101 and 102 define a through-channel 107. This starts from a valve inlet 109 at the end face of the first housing part 101 and extends with a first cylindrical channel section 111 to a first conical widening 112, which is followed by a second cylindrical channel section 113, which passes via a second conical widening 114 into a third cylindrical channel section 115. The third cylindrical channel section 115 is surrounded by a casing 117 of the first housing part 101. With a cup-shaped insert 119, which defines a fourth cylindrical channel section 120 of the through-channel 107, the second housing part 102 enters the casing 117.

The insert 119 is integrally connected to a bottom wall 122 of the second housing part 102, which closes off the free end of the casing 117 of the first housing part 101. At the side facing away from the insert 119, the bottom wall 122 is followed by a cylindrical extension 123, which like the bottom wall 122 has an axially extending through-bore 124 passing through it. The through-bore 124 forms a fifth cylindrical channel section 125 of the through-channel 107, with a stepped narrowing 126 arranged in the area of transition between the fourth channel section 120 and the fifth channel section 125.

The cup-shaped insert 119 carries on its outer side an annular groove 129, in which a sealing ring 130 is arranged, which ensures a fluid-tight connection between the first housing part 101 and the second housing part 102.

Mounted for movement inside the through-channel 107 is a valve element 132 with a closure member 133 in the form of a spherical cap and a pressure member 134 following the closure member 133 in the axial direction. In the closed position of the relief valve 98 shown in FIG. 4, the closure member 133 bears tight against a valve seat 136 formed by the first conical widening 112. The pressure member 134 extends from the closure member 133 into the area of the fourth channel section 120 where it carries on the outside an annular groove 138 in which there is arranged a sealing ring 139, which surrounds the valve element 132 in the circumferential direction. The inner diameter of the sealing ring is selected so as to be larger than the inner diameter of the annular groove 138. This has the consequence that the sealing ring 139 is spaced from the bottom of the annular groove 138, as shown in FIG. 4. At the outside, the sealing ring 139 bears tight against the wall of the fourth channel section 120.

At a spacing from the closure member 133, the pressure member 134 has a collar 144 below the longitudinal axis 141 of a radially extending outlet channel 142. A return spring 146 configured as a helical spring, which surrounds the pressure member 134 in the third channel section 115 in the circumferential direction, is supported, on the one hand, on the free end face 148 of the cup-shaped insert 119, which faces the valve seat 136, and, on the other hand, on the underside 149 of the collar 144, which faces away from the valve seat 136. The valve element 132 is acted upon with a spring force in the direction towards the valve seat 136 by the return spring 146.

The fifth channel section 125 passing through the bottom wall 122 and the axial extension 123 forms with its free end area a first valve outlet 151, and the outlet channel 142 starting from the through-channel 107 forms with its radially outwardly lying end area a second valve outlet 152. The through-channel 107 is divided by the sealing ring 139 surrounding the valve element 132 in the circumferential direction into an inlet area 154 and an outlet area 155, which are separated from each other in a fluid-tight manner by the sealing ring 139. The inlet area 154 is formed by the first channel section 111, the first conical widening 112, the second channel section 113, the second conical widening 114, the third channel section 115 and the part of the fourth channel section 120 that is adjacent to the free end face 148. The outlet area 155 of the through-channel 107 is formed by the part of the fourth channel section 120 that is adjacent to the stepped narrowing 126 and by the fifth channel section 125.

During normal operation of the high-pressure cleaning appliance, the relief valve 98 adopts its closed position in which the valve element 132 bears with the closure member 133 tight against the valve seat 136. When a certain pressure value of the cleaning liquid inside the pressure line 28 is exceeded, the valve element 132 is lifted off of the valve seat 136 in opposition to the force of the return spring 146 until the pressure member 134 bears with its end facing away from the closure member 133 against the stepped narrowing 126. The stepped narrowing 126 therefore forms a stop for delimiting the stroke of the valve element 132. A flow connection from the valve inlet 107 to the second valve outlet 152 is opened by the valve element 132 lifting off of the valve seat 136, so that excess liquid can escape from the pressure line 28 through the return flow line 36 to the suction line 25. A considerable pressure thereby arises in the inlet area 154 of the through-channel 107, whereas a considerably lower pressure, namely the pressure prevailing in the suction line 25, is present in the outlet area 155. This causes a differential pressure to act on the valve element 132, which results in a force being applied away from the valve seat 136. Owing to the application of this force, the valve element 132 maintains its position at a spacing from the valve seat 136 until the excess pressure drops in the pressure line 28. The pressure drop occurs gradually as the flow cross section of the outlet channel 142 is chosen so as to be smaller than the flow cross section of the through-channel upstream of the outlet channel 142. The outlet channel 142 forms a throttle element for the cleaning liquid flowing through the relief valve 98, which ensures that a considerable pressure builds up in the inlet area 154 of the through-channel 107 when the relief valve 98 adopts its open position.

The invention claimed is:

1. A high-pressure cleaning appliance with a high-pressure pump, comprising:

at least one pump chamber which is connected to a suction line and a pressure line, the pressure line being in flow connection with the suction line via a return flow line, and a relief valve in the return flow line, the relief valve comprising:

a through-channel extending from a valve inlet to a first valve outlet and forming a valve seat, said first valve outlet forming a leakage opening, at least one outlet channel, which opens into a second valve outlet, branching off from the through-channel downstream of the valve seat, a valve element adapted to be positioned by a return spring in a sealing manner against the valve seat, said valve element being held for movement in the through-channel, wherein:

in a direction away from the valve seat, at a distance downstream from the at least one outlet channel, the valve element is surrounded by a first sealing ring which seals off communication between the valve inlet and the first valve outlet, the valve element comprises a closure member which is adapted to be positioned in a sealing manner against the valve seat and a pressure member which is surrounded by the first sealing ring at a spacing from the closure member, the relief valve comprises a first housing part connectable to a second housing part via a second sealing ring disposed therebetween, the second housing part comprises a cup-shaped insert that defines a channel-section of the through-channel and enters the first housing part, the pressure-member extends from the closure member into an area of said channel-section in which the pressure member is surrounded in a circumferential direction by the first sealing ring, a stop is associated with the valve element and the valve element bears on the stop when the relief valve is in an open position, and the stop is formed by a stepped narrowing of the through-channel.

2. A high-pressure cleaning appliance in accordance with claim 1, wherein the first sealing ring is arranged in a circumferential groove of the valve element.

3. A high-pressure cleaning appliance in accordance with claim 2, wherein an inner diameter of the first sealing ring is greater than an inner diameter of the circumferential groove.

4. A high-pressure cleaning appliance in accordance with claim 1, wherein the pressure member is mounted for displacement along an inner wall of said channel-section, with the first sealing ring disposed between said inner wall and said pressure member.

5. A high-pressure cleaning appliance in accordance with claim 1, wherein a flow cross section of the through-channel in an area upstream of the at least one outlet channel is greater than a flow cross section of the outlet channel.

6. A high-pressure cleaning appliance in accordance with claim 1, wherein the relief valve comprises a single outlet channel.

7. A high-pressure cleaning appliance in accordance with claim 1, wherein the valve element at least partially opens the at least one outlet channel in both the open position and a closed position of the relief valve.

* * * * *